US009200825B2

(12) United States Patent
Rieder

(10) Patent No.: US 9,200,825 B2
(45) Date of Patent: Dec. 1, 2015

(54) CONTROL SYSTEM FOR AN ARTIFICIAL SNOW MAKING PLANT

(71) Applicant: TECHNOALPIN HOLDING S.P.A., Bolzano (IT)

(72) Inventor: Walter Rieder, Cornedo all'Isarco (IT)

(73) Assignee: TECHNOALPIN HOLDING S.P.A., Bolzano (IT)

( * ) Notice: Subject to any disclaimer, the term of this patent is extended or adjusted under 35 U.S.C. 154(b) by 64 days.

(21) Appl. No.: 13/919,646

(22) Filed: Jun. 17, 2013

(65) Prior Publication Data

US 2014/0091158 A1 Apr. 3, 2014

(30) Foreign Application Priority Data

Sep. 28, 2012 (IT) ..... VR2012A0193

(51) Int. Cl.
*F25C 3/04* (2006.01)
*B05B 12/08* (2006.01)

(52) U.S. Cl.
CPC ..... *F25C 3/04* (2013.01); *B05B 12/085* (2013.01); *F25C 2303/048* (2013.01)

(58) Field of Classification Search
CPC .. F25C 3/04; F25C 2303/00; F25C 2303/048; B05B 12/084; B05B 12/12; B05B 12/085
USPC ..... 239/2.2, 14.2, 63, 67, 68, 71, 75; 700/241, 283
See application file for complete search history.

(56) References Cited

U.S. PATENT DOCUMENTS

| | | | | |
|---|---|---|---|---|
| 4,717,072 | A | 1/1988 | Girardin | |
| 5,031,832 | A | 7/1991 | Ratnik et al. | |
| 5,154,348 | A * | 10/1992 | Ratnik et al. | 239/14.2 |
| 5,400,965 | A * | 3/1995 | Ratnik et al. | 239/14.2 |
| 6,554,200 | B1 * | 4/2003 | Satonaka | 239/2.2 |
| 2002/0116122 | A1 | 8/2002 | Satonaka | |

FOREIGN PATENT DOCUMENTS

KR 20020006111 A 1/2002

* cited by examiner

*Primary Examiner* — Darren W Gorman
(74) *Attorney, Agent, or Firm* — Pearne & Gordon LLP

(57) ABSTRACT

Described is a system (1) for controlling an artificial snow making plant (100) having a plurality of snow making apparatuses (101) positioned along a ski run and connected to a communication line (102), comprising a processing unit (2) in data connection with the communication line (102) and being designed for:

receiving a status signal (S) from each snow making apparatus (101) representing the quantity of snow currently produced by the relative snow making apparatus (101);

comparing the data contained in each status signal (S) with a respective predetermined single snow making value ($P_f$) to be reached;

generating a condition signal (P) of the apparatuses (101) as a function of the comparison; —generating a condition signal P of the ski run as a function of the contents of the condition signal (A) of the apparatuses (101).

13 Claims, 2 Drawing Sheets

CONTROL SYSTEM FOR AN ARTIFICIAL SNOW MAKING PLANT

FIELD OF THE INVENTION

This invention relates to a control system for an artificial snow making plant. More specifically, the invention relates to an artificial snow making plant having a plurality of snow making apparatuses positioned along a ski run and connected to a communication line.

DESCRIPTION OF RELATED ART

The installation of artificial snow making systems along a ski run is known for compensating a lack of natural snow or to form the snowy underlayer of a ski run. More specifically, each snow making apparatus comprises a snow making device (commonly called "snow cannons") and a respective unit (commonly known as "chamber") for feeding a snow making liquid connected to the relative snow making device.

More specifically, the snow making device is positioned close to the respective unit for feeding the snow making liquid and covers a predetermined geographical snow making area of the ski run. Thus, in this description, the snow making apparatus is the general term defining the assembly of the snow making device (snow cannon) and the unit for feeding the snow making liquid (chamber) which cover a predetermined geographical snow making area. The series of geographical snow making areas define the surface of the ski run.

In the prior art the snow making apparatus is connected to a communication line in such a way as to manage it from a control station located downstream or in a well defined place. More specifically, the prior art control systems comprise a processing unit connected to the communication line and designed for controlling the status of the apparatus and for managing the operation as a function of the various climatic conditions.

This prior art, however, is not free of disadvantages.

In effect, the control systems do not generally allow the snow conditions of the ski run to be checked. For this reason, it occurs that the snow making apparatuses produce more snow than necessary for opening the ski run to the public, or they do not produce sufficient snow for the opening of the ski run to the public. In other cases, the main drawback consists in the fact that in some areas of the ski run there is more snow than necessary for opening the ski run to the public, whilst in other areas of the ski run there is not sufficient snow for the opening of the ski run.

SUMMARY OF INVENTION

In this situation, the aim of this invention is to make a control system for an artificial snow making plant that overcomes the drawbacks of the prior art.

More specifically, the aim of this invention is to make a control system which allows the snow conditions of the ski run to be monitored.

Moreover, the aim of this invention is to make a control system which allows the time for covering the ski run with snow to be estimated.

Lastly, the aim of this invention is to make a control system which allows the geographical areas of the ski run having a level of snow cover less than a minimum predetermined level to be identified.

The aims indicated are substantially achieved by a control system for an artificial snow making plant as described in the appended claims.

BRIEF DESCRIPTION OF DRAWINGS

Further characteristic features and advantages of this invention will emerge more clearly from the detailed description of a preferred, but not exclusive embodiment of a control system for an artificial snow making plant illustrated in the accompanying drawings, in which.

DETAILED DESCRIPTION OF PREFERRED EMBODIMENTS OF THE INVENTION

With reference to the said figures, the numeral 1 denotes in its entirety a control system for an artificial snow making plant 100.

As previously defined, the artificial snow making plant 100 comprises a plurality of snow making apparatuses 101 positioned along a ski run and connected in series to a communication line 102.

Figure 1:
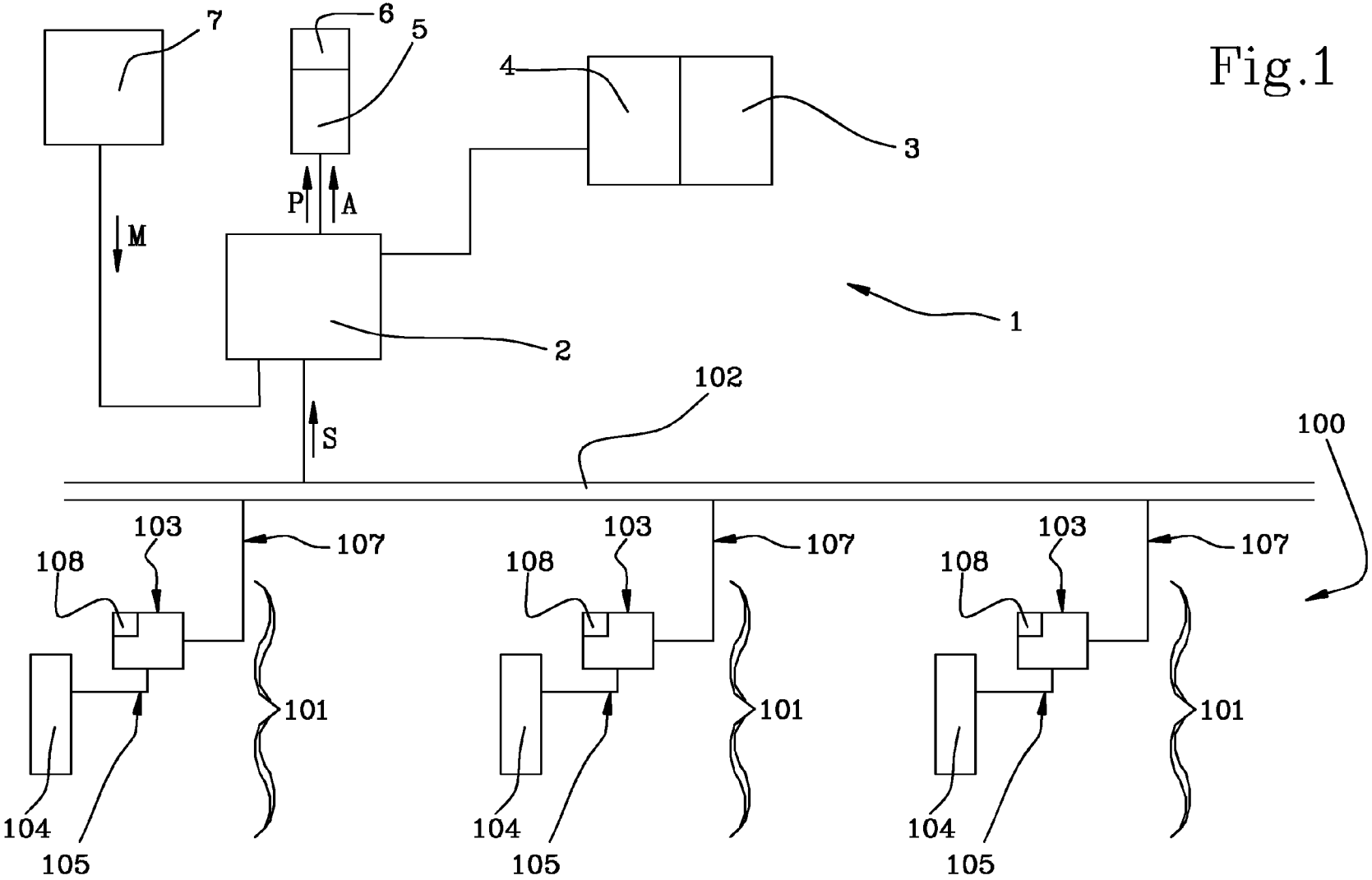
FIG. 1 is a schematic view of a control system for an artificial snow making plant according to the invention.

More specifically, each snow making apparatus 101 comprises a snow making device 103 (commonly called "snow cannon") and a respective unit 104 (commonly known as "chamber") for feeding a snow making liquid connected to the snow making device 103. FIG. 1 shows a snow making device 103 of an apparatus 101 connected to the communication line 102 by a data line 107. Moreover, each feeding unit 104 is connected to the snow making device 103 by conduit 105 in which the snow making liquid flows.

More specifically, the snow making device 103 is positioned close to a respective unit 104 for feeding the snow making liquid and covers a predetermined geographical snow making area of the ski run.

The control system 1 comprises a processing unit 2 in data connection with the communication line 102. More specifically, the processing unit 2 is designed for receiving a status signal S from each snow making apparatus 101.

The status signal S represents the quantity of snow currently produced by the snow making apparatus 101. In other words, the status signal S represents the quantity of snow which a snow making apparatus 101 has produced. More in detail, the status signal S contains the data relative to the quantity of snow making liquid consumed by the apparatus 101. For this reason, the status signal S represents the quantity of snow currently produced since the quantity of snow currently produced depends on the quantity of snow making liquid consumed.

In detail, the status signal S is generated by the feeding unit 104 ("chamber") of the snow making apparatus 101 and transmitted to the processing unit 2.

Moreover, the processing unit 2 is designed for comparing the data contained in each status signal S with a respective predetermined single snow making value $P_f$ to be reached and representing a preset quantity of snow to be produced. More in detail, the predetermined single snow making value $P_f$ represents the "target" to be reached starting from an initial snow covering status.

Moreover, the processing unit 2 is designed for generating a condition signal A of the apparatuses 101 as a function of the comparison. The condition signal A of the apparatuses 101 represents the difference between the quantity of snow currently produced by each apparatus and the respective single snow making value $P_f$.

Moreover, the processing unit 2 is designed for generating a condition signal P of the ski run as a function of the contents of the condition signal A of the apparatuses 101. The condition signal P of the ski run represents the current snow status of the ski run.

In detail, the processing unit 2 is designed for:

determining the number of apparatuses 101 which have currently produced a quantity of snow greater than the respective single snow making value $P_f$;

comparing the number of apparatuses 101 determined with a predetermined minimum insolvency value $P_f$;

determining the condition signal P of the ski run as a function of the comparison.

If the number of apparatuses 101 which satisfy the production of snow corresponding with the single snow making value $P_f$ is less than the minimum insolvency value it means that the ski run is in a seriously insufficient snow covering condition.

In detail, if the number of apparatuses 101 which satisfy the production of snow corresponding with the single snow making value $P_f$ is greater than the minimum insolvency value it means that the ski run is in an insufficient snow covering condition.

If all the apparatuses 101 satisfy the production of snow corresponding with the single snow making value $P_f$ it means that the ski run is in a sufficient snow covering condition.

Moreover, in order to generate the condition signal A of the apparatuses 101, the processing unit 2 is designed for comparing the data contained in each status signal S with a respective predetermined minimum snow making value $P_{min}$ representing a predetermined minimum quantity of snow. It should be noted that the predetermined minimum snow making value $P_{min}$ is less than the single snow making value $P_f$.

As described in more detail below with reference to FIG. 2, the minimum snow making value $P_{min}$ represents the snow covering threshold between a first area P1 and a second area P2 relative to an apparatus 101. Preferably, the minimum snow making value $P_{min}$ represents the snow covering threshold between the first area P1 and the second area P2 relative to the feeding unit 104 ("chamber") of the apparatus 101.

More specifically, the condition signal A of the apparatuses 101 is determined as a function of the quantity of snow making liquid consumed by the relative apparatus 101. More specifically, the quantity of snow making liquid consumed is compared with the minimum snow making value $P_{min}$ to be exceeded.

The processing unit 2 is designed for updating the condition signal A of the apparatuses 101 as a function of the comparison.

It should be noted that the predetermined minimum snow making value $P_{min}$ is defined by a reference curve variable over time. For this reason, the comparison of the data contained in each status signal S with the minimum single snow making value $P_{min}$ is performed periodically with reference to the data contained in each status signal S at a predetermined moment in time $D_a$ with the minimum snow making value $P_{min}$ referred to the same predetermined moment in time $D_a$.

Figure 2:
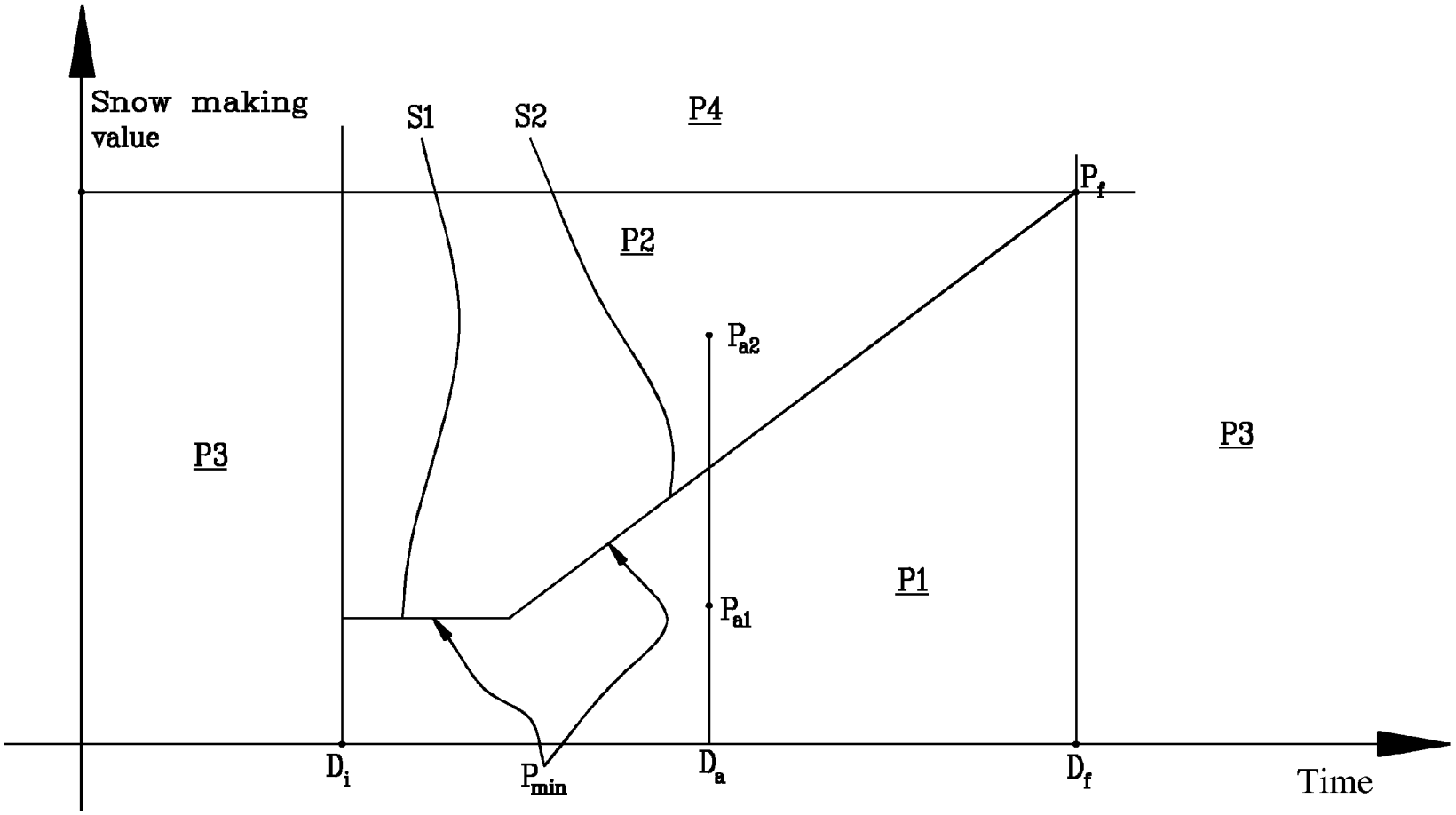
FIG. 2 is a schematic view of a graphical curve relative to the condition of snow covering of a ski run.

In this regard, FIG. 2 shows a graph which allows the snow making status of a snow making apparatus 101 positioned in a relative position of the ski run to be determined.

More in detail, the curve relative to the minimum single snow making value $P_{min}$ is shown in FIG. 2 and it comprises a first segment S1 constant over time and a second segment S2 variable over time.

More specifically, FIG. 2 shows that the minimum snow making value $P_{min}$, along the second segment S2, increases with the increase in time. In yet other words, the minimum snow making value $P_{min}$ increases with the approach of the preset time of ending snow making $D_f$.

Moreover, two points are shown at the current time $D_a$ which represent, respectively, two different current snow making values $P_{a1}$ and $P_{a2}$ (first and second current snow making values) which could, alternatively, have been produced by the snow making apparatus 101. As can be seen in FIG. 2, the first current snow making value $P_{a1}$ symbolises that the apparatus 101 is not producing the snow necessary for the opening of the plant 100. In effect, the point representing the first current snow making value $P_{a1}$ is located beneath the reference curve.

The second current snow making value $P_{a2}$ symbolises that the apparatus 101 has produced a quantity of snow greater than the minimum snow making value $P_{min}$.

In effect, the point representing the second current snow making value $P_{a2}$ is located above the reference curve.

Moreover, the reference curve defining the trend over time of the minimum snow making value $P_{min}$ divides the main graph into four zones:

a first zone P1 between the X-axis and the reference curve identifying a zone in which the current snow making value $P_a$ is less than the minimum snow making value $P_{min}$;

a second zone P2 extending above the reference curve identifying a zone in which the current snow making value $P_a$ is greater than the minimum snow making value $P_{min}$;

a third zone P3 defined upstream of the time of starting snow making $D_i$ and downstream of the time of ending snow making $D_f$, the zone identifying a period of time outside the start date $D_i$ and end date $D_f$ of snow making;

a fourth zone P4 between the time of starting snow making $D_i$ and the time of ending snow making $D_f$ and greater than a target line identifying the single snow making value to be reached. The target line is positioned above the reference curve.

It should be noted that the first segment S1 defines a minimum snow product threshold. Advantageously, the presence of the first segment S1 distinguishes more clearly zone P1 from zone P2 at the time of starting snow making so as to avoid creating the illusion (for the user) that the quantity of snow produced by the apparatus, at the time $D_i$, is already greater than the minimum snow making value $P_{min}$.

It should also be noted that the times of starting snow making $D_i$ and ending snow making $D_f$ on the ski run are pre-set times by the user and might not coincide with the actual times of switching on the snow making equipment.

Moreover, the apparatus comprises a storage unit 4 connected to the processing unit 2 in which the data relative to the quantity of snow produced by the snow making apparatuses 101 in previous years is stored with reference to an annual period corresponding to the current period.

More specifically, the processing unit 2 is designed for calculating the overall remaining snow making time to reach an overall snow making value as a function of the data contained in the status signal S, in the condition signal A of the apparatuses 101 and as a function of the data contained in the storage unit 4. It should be noted that the overall snow making value is defined by the sum of the single snow making values $P_f$.

Moreover, the control unit is designed for calculating the remaining single snow making time $T_{INN}$ relative to each apparatus 101 for reaching the predetermined single snow making value $P_f$ as a function of the data contained in the status signal S, the data contained in the condition signal A of the apparatus 101 and the data contained in the storage unit 4. In effect, by knowing the current snow making status of each area of the ski run and by knowing the information relative to the comparison of the snow making status of each area of the ski run with respect to the single snow making value $P_f$ (information contained in the condition signal P of the ski run) it is possible to calculate the remaining snow making time $T_{INN}$ for that area of the ski run until reaching the single snow making value $P_f$.

After that, the control unit 2 is configured for identifying, between the calculated single snow making times $T_{INN}$, the maximum remaining single snow making time. The overall remaining snow making time for reaching the overall value is defined by the maximum calculated remaining single snow making time.

In other words, the control unit 2 is configured for identifying, between the calculated single snow making times, the greatest remaining single snow making time $T_{INN}$. In effect, since the apparatuses 101 operate simultaneously, the overall remaining snow making time for reaching the overall value is defined by the apparatus 101 which has the greatest remaining single snow making time $T_{INN}$.

It should also be noted that the processing unit 2 is designed for calculating the remaining quantity of snow $P_{RIM}$ to be produced for reaching the single snow making value $P_f$ as a function of the data contained in the condition signal A of the apparatuses 101 and as a function of the data contained in the storage unit 4.

Moreover, the processing unit 2 is designed for estimating the remaining single snow making time $T_{INN}$ as a function of the current production of snow of the apparatus in a predetermined temperature range. The remaining single snow making time $T_{INN}$ is calculated by dividing the value of the remaining quantity of snow $P_{RIM}$ by an average historical flow value $F_{STO}$ representing the average quantity $P_{STO}$ of snow produced in the past in a period corresponding to the current period in the same temperature range and multiplying the result of the division by a predetermined historical single snow making time $T_{INN-STO}$ relative to the average time historically taken by an apparatus 101 to cover with snow a certain area. In other words, the snow making time is calculated with the following formula:

$$T_{INN} = \frac{P_{RIM}}{P_{STO}} * T_{STO-INN}$$

It should be noted that the average historical flow value $F_{STO}$, the historical average quantity $P_{STO}$ and the historical single snow making time $T_{INN-STO}$ are stored in the storage unit 4.

Alternatively, if the storage unit 4 does not contain data relative to the snow making for periods of the year corresponding to the current period, the processing unit 2 is configured for calculating a maximum single snow making time $T_{INN-MAX}$ and a minimum single snow making time $T_{INN-MIN}$ in a predetermined temperature range. The maximum single snow making time $T_{INN-MAX}$ is calculated by dividing the value of the quantity of snow remaining $P_{RIM}$ by a predetermined minimum flow value $F_{MIN}$ representing the quantity of snow which can be produced in the unit of time by a first type of snow making apparatus 101 in the corresponding temperature range. The minimum single snow making time $T_{INN-MIN}$ is calculated by dividing the value of the quantity of snow remaining $P_{RIM}$ by a predetermined maximum flow value $F_{MAX}$ representing the quantity of snow which can be produced by a second type of snow making apparatus 101 in the corresponding temperature range. The remaining single snow making time $T_{INN}$ is, therefore, between the maximum single snow making time $T_{INN-MAX}$ and the minimum single snow making time $T_{INN-MIN}$.

It should also be noted that the first type of apparatus 101 has a snow production performance less than the snow production performance of the second type of apparatus 101. In other words, the maximum $T_{INN-MAX}$ and minimum $T_{INN-MIN}$ snow making times are calculated using the following formulae:

$$T_{INN-MIN} = \frac{P_{RIM}}{F_{MAX}};$$

$$T_{INN-MAX} = \frac{P_{RIM}}{F_{MIN}}$$

It should be noted that the single snow making time $T_{INN}$ is calculated as a function of a predetermined temperature range. In effect, the snow making time varies according to the ambient temperature in which the apparatuses 101 operate. In detail, the control system 1 has four different temperature ranges with reference to which the single snow making time $T_{INN}$ can be calculated.

Moreover, the control system 1 comprises a basic storage unit 3 in which the following are pre-stored:

- the overall snow making value;
- the minimum snow making values $P_{min}$;
- the single snow making values $P_f$;
- the maximum insolvency value;
- parameters of the apparatus 101.

Moreover, the basic storage unit 3 is designed for storing an activation priority value for each snow making apparatus. More specifically, the processing unit 2 is designed for modifying the activation priority value as a function of the contents of the condition signal A of the apparatuses 101. Yet more specifically, the processing unit 2 is designed for modifying the activation priority value as a function of the apparatuses which have a snow production deficit. In other words, the processing unit 2 is designed for increasing the activation priority value as a function of the apparatuses 101 which have produced a quantity of snow less than the single snow making value $P_f$. It should be noted that the higher the priority value relative to an apparatus 101 the sooner that apparatus 101 will be activated.

In addition, the control system 1 comprises a graphics interface 5 connected to the processing unit 2 for displaying, in real time:

- the remaining overall snow making time for reaching the final overall snow making value,
- the remaining single snow making time $T_{INN}$ for reaching the single snow making value $P_f$,
- the contents of the condition signal A of the apparatuses 101,
- the contents of the condition signal P of the ski run,
- the graph (FIG. 2) relative to the reference curve which defines the trend over time of the minimum snow making value $P_{min}$,
- the geographical map along which the snow making plant 100 is installed.

In this way, a user can monitor and control the data relative to the covering with snow of the ski run.

Moreover, it should be noted that the system 1 comprises a module 6 connected to the processing unit 2 and to the basic storage unit 3 designed for modifying the data contained in the basic storage unit 3. The module 6 allows the user to manually correct the data contained in the basic storage unit 3. The module 6 is connected to the graphics interface 5 for the graphical management of the data to be corrected.

More specifically, the system 1 can be connected to the weather forecasting unit 7 which makes weather forecasts for the ski run to be covered with snow. More specifically, the processing unit 2 is designed for receiving a weather forecast signal M and for sending it to the graphics interface 5. In other words, the graphics interface 5 is configured for displaying the data contained in the weather forecast signal M. In this way, the user can adjust the progress of the snow production of one or more apparatuses 101 as a function of the contents of the weather forecast signal M. The adjustment may take place, for example, by switching OFF and successive switching ON of the apparatuses 101. For example, the user can interrupt the snow making operations of one or more apparatuses 101 (by switching them OFF) for a certain period of time awaiting a moment in time (subsequent to that period of time) wherein a lowering of the temperatures is forecast according to the content of the weather forecast signal M. In other words, the apparatuses 101 are switched ON again after the time instant in which the lowering of the temperatures is forecast. In effect, if the temperature is lower, the costs linked to the snow production are also lowered, and it is therefore more worthwhile for the user to operate the apparatuses 101.

This invention relates to an artificial snow making plant 100 having a plurality of snow making apparatuses 101 each comprising a unit 104 for feeding a snow making liquid (commonly known as "chamber") and a snow making device 103 (commonly known as "snow cannon") for generating the artificial snow connected to the feeding unit 104 for drawing the snow making liquid. More specifically, the snow making apparatuses 101 are connected to a communication line 102. The addition, the artificial snow making plant 100 comprises the control system 1 described above.

It should be noted in particular that the quantity of snow produced by each snow making apparatus 101 is calculated on the basis of the quantity of snow making liquid passing in the relative unit 104 for feeding the snow making liquid.

More in detail, the contents of the status signal S are defined by the quantity of snow making liquid currently consumed by the apparatus 101, whilst the single snow making value $P_f$ and the overall snow making value are defined by the quantity of snow making liquid to be fed to the apparatus 101.

In detail, the snow making device 103 ("snow cannon") comprises a relative process unit 108 designed for calculating the flow of snow making liquid fed to the snow making device 103. More in detail, the process unit 108 calculates the flow of snow making liquid as a function of the pressure of the snow making liquid fed to the apparatus 101 and of the number of open and/or closed passage valves.

In this way, the process unit 108 generates the status signal S and the processing unit 2 receives the status signal S. In other words, the process unit 108 is designed for generating the status signal S to be sent to the processing unit 2.

Then, the processing unit 2 is designed for calculating the volume of snow making liquid consumed as a function of the contents of the status signal S. More specifically, the processing unit 2 is designed for calculating the volume of snow making liquid consumed by the mathematical integration of the flow of snow making liquid over time. In that way, the processing unit 2 can determine the quantity (as a volume) of snow making liquid consumed by one or more apparatuses 101.

In any case, it should be noted that the status signal S contains the data relative to the flow of snow making liquid passing through the apparatus 101 and, therefore, already represents the quantity of liquid consumed by the apparatus 101.

FIG. 1 shows that the process unit 108 of the snow making device 103 is connected to the communication line 102.

The invention achieves the preset aims.

In effect, this invention allows the snow covering status of the ski run to be monitored thanks to the calculation of the quantity of snow making liquid currently consumed by each chamber. Moreover, this invention allows the snow covering times of the ski run to be estimated thanks to the real time comparison between the quantity of snow making liquid currently consumed and a "target" level of the quantity of snow making liquid to be consumed to reach a snow covering status sufficient for opening the ski run. More specifically, the "target" level is determined as a function of the quantity of snow making liquid consumed in the past.

Lastly, this invention allows the geographical areas of the ski run to be identified which have a snow covering level less than the predetermined minimum level. In effect, the control system allows the quantity of snow produced by the single snow making apparatuses to be monitored and to monitor the snow making apparatuses which do not satisfy the minimum requirements of artificial snow produced.

It should also be noted that this invention is relatively easy to produce and that even the cost linked to implementation of the invention is not very high.

The invention claimed is:

1. A system (1) for controlling an artificial snow making plant (100) having a plurality of snow making apparatuses (101) positioned along a ski run and connected to a communication line (102), comprising:

a processing unit (2) connected with the communication line (102); the processing unit (2) being programmed so that it can:

receive a status signal (S) from each snow making apparatus (101); the status signal (S) representing a quantity of snow currently produced by the relative snow making apparatus (101), wherein the relative snow making apparatus (101) comprises a process unit (108) that generates the status signal (S) as a function of a pressure of the snow making liquid fed to the apparatus (101) and of a number of open and/or closed passage valves;

compare the data contained in each status signal (S) with a respective predetermined single snow making value ($P_f$) to be reached and representing a preset quantity of snow to be produced;

generate a condition signal (A) of the apparatuses (101) as a function of the comparison; the condition signal (A) of the apparatuses (101) representing the difference between the quantity of snow currently produced by each apparatus (101) and the respective single snow making value ($P_f$);

generate a condition signal (P) of the ski run as a function of the contents of the condition signal (A) of the apparatuses (101); the condition signal (P) of the ski run representing the current snow status of the ski run for identifying geographical areas of the ski run which have a snow covering level less than a predetermined minimum level.

2. The control system (1) according to claim 1, characterised in that the processing unit (2) is programmed so that it can:

determine the number of apparatuses (101) which have currently produced a quantity of snow greater than the respective single snow making value ($P_f$);

compare the number of apparatuses (101) determined with a predetermined minimum insolvency value ($P_f$);

determine the condition signal (P) of the ski run as a function of the comparison.

3. The control system (1) according to claim 1, characterised in that the processing unit (2) is further programmed so that it can:

compare the data contained in each status signal (S) with a respective predetermined minimum snow making value ($P_{min}$) representing a minimum quantity of snow; the predetermined minimum snow making value ($P_{min}$) being less than the single snow making value ($P_f$);

modify the condition signal (A) of the apparatuses (101) as a function of the comparison.

4. The control system (1) according to claim 3, characterised in that the predetermined minimum snow making value ($P_{min}$) is defined by a reference curve variable over time; the processing unit (2) being programmed so that it can perform periodically the comparison of the data contained in each status signal (S) with the minimum snow making value ($P_{min}$) with reference to the data contained in each status signal (S) at a predetermined moment in time ($D_a$) with the minimum snow making value ($P_n$) referred to the same predetermined moment in time ($D_a$).

5. The control system (1) according to claim 1, characterised in that it comprises a storage unit (4) connected to the processing unit (2) in which the data relative to the quantity of snow produced by the snow making apparatuses (101) in previous years is stored with reference to an annual period corresponding to the current period.

6. The control system (1) according to claim 5, characterised in that the processing unit (2) is programmed so that it can calculate the overall remaining snow making time to reach an overall snow making value as a function of the data contained in the status signal (S), in the condition signal (A) of the apparatuses (101) and as a function of the data contained in the storage unit (4); the overall snow making value being defined by the sum of the single snow making values ($P_f$).

7. The control system (1) according to claim 6, characterised in that the processing unit (2) is programmed so that it can:

calculate the remaining single snow making time ($T_{INN}$) relative to each apparatus (101) for reaching the predetermined single snow making value ($P_f$) as a function of the data contained in the status signal (S), the data contained in the condition signal (A) of the apparatus (101) and the data contained in the storage unit (4);

identify, between the calculated single snow making times ($T_{INN}$), the maximum remaining single snow making time ($T_{INN}$); the overall remaining snow making time for reaching the overall value being defined by the maximum calculated remaining single snow making time ($T_{INN}$).

8. The control system (1) according to claim 7, characterised in that the processing unit (2) is programmed so that it can calculate the remaining quantity of snow ($P_{RIM}$) to be produced for reaching the single snow making value ($P_f$) as a function of the data contained in the condition signal of the apparatuses (A) and as a function of the data contained in the storage unit (4).

9. The control system (1) according to claim 8, characterised in that the processing unit (2) is programmed so that it can calculate the remaining single snow making time ($T_{INN}$) as a function of the current snow production of the apparatus in a predetermined temperature range; the remaining single snow making time ($T_{INN}$) being calculated by dividing the value of the remaining quantity of snow ($P_{RIM}$) by an average historical flow value ($F_{sto}$) representing the average quantity ($P_{sto}$) of snow produced in the past in a period corresponding to the current period in the same temperature range and multiplying the result of the division by a historical single snow making time ($T_{INN\text{-}STO}$) relative to the average time historically taken by an apparatus (101) to cover with snow a certain area; the average historical flow value ($F_{STO}$), historical average quantity ($P_{STO}$), historical single snow making time ($T_{INN\text{-}STO}$) being stored in the storage unit (4).

10. The control system (1) according to claim 8, characterised in that, if the storage unit (4) does not contain data regarding the snow making in periods of the year corresponding to the current one, the processing unit (2) is programmed so that it can calculate a maximum single snow making time ($T_{INN\text{-}MAX}$) and a minimum single snow making time ($T_{INN\text{-}MIN}$) in a predetermined temperature range; the maximum single snow making time ($T_{INN\text{-}MAX}$) being calculated by dividing the value of the remaining quantity of snow ($P_{RIM}$) by a predetermined minimum flow value ($F_{MIN}$) representing the quantity of snow which can be produced in the unit of time by a first type of snow making apparatus (101) in the temperature range; the minimum single snow making time ($T_{INN\text{-}MIN}$) being calculated by dividing the value of the remaining quantity of snow ($P_{RIM}$) by a predetermined maximum flow value ($F_{MAX}$) representing the quantity of snow which can be produced by a second type of snow making apparatus (101) in the temperature range; the remaining single snow making time ($T_{INN}$) being between the maximum single snow making time ($T_{INN\text{-}MAX}$) and the minimum single snow making time ($T_{INN\text{-}MIN}$); the first type of apparatus (101) having a snow production performance less than the snow production performance of the second type of apparatus (101).

11. The control system (1) according to claim 7, characterised in that it comprises a graphics interface (5) connected to the processing unit (2) for displaying, in real time, the overall remaining snow making time for reaching the overall final snow making value, the remaining single snow making time ($T_{INN}$) for reaching the single snow making value ($P_f$), the contents of the condition signal (A) of the apparatuses (101), the contents of the condition signal (P) of the ski run and the geographical map along which the snow making plant (100) is installed.

12. An artificial snow making plant (100) comprising:

a plurality of snow making apparatuses (101) each comprising a unit (104) for feeding a snow making liquid and a snow making device (103) for generating the artificial snow connected to the feeding unit (104) for drawing the snow making liquid; characterised in that it comprises a control system (1) according to claim 1.

13. The snow making plant (100) according to claim 12 characterised in that the quantity of snow produced by each snow making apparatus (101) is calculated on the basis of the quantity of snow making liquid passing in the relative unit (104) for feeding the snow making liquid.

* * * * *